United States Patent [19]

Austin et al.

[11] 4,442,850

[45] Apr. 17, 1984

[54] COIN COUNTER

[75] Inventors: Warren Austin; Alex Penny, both of West Chester, Pa.

[73] Assignee: Aaccurate Counters Company, West Chester, Pa.

[21] Appl. No.: 352,699

[22] Filed: Feb. 26, 1982

[51] Int. Cl.[3] ..... G07D 3/12

[52] U.S. Cl. ..... 133/3 H; 133/8 R

[58] Field of Search ..... 194/102, 99; 133/3 R, 133/3 D, 3 H, 8 R, 8 A

[56] References Cited

U.S. PATENT DOCUMENTS

| | | | |
|---|---|---|---|
| 3,565,086 | 2/1971 | Zimmermann | 133/8 R |
| 4,172,462 | 10/1979 | Uchida et al. | 133/8 R X |
| 4,216,788 | 8/1980 | Watanabe et al. | 133/8 R |
| 4,370,990 | 2/1983 | Watanabe | 133/8 A |

*Primary Examiner*—Stanley H. Tollberg

*Attorney, Agent, or Firm*—Dann, Dorfman, Herrell and Skillman

[57] ABSTRACT

A portable coin counter for counting, totalizing, and packaging various denominations of coins. Coins are deposited in the coin inlet of the coin counter and are fed successively along a guide channel by a conveyor where the coins are counted by a counter and subsequently discharged to a packaging element through a coin outlet. A gate is provided at the entrance end of the guide channel to block passage of coins having a thickness greater than a selected threshold thickness. To permit operation with various denominations of coins, the gate is adjustable for adjusting the selected threshold thickness to different selected amounts. An off-size coin separator is provided along the guide channel for rejecting from the guide channel coins having a diameter smaller than a selected diameter while preventing the conveyance of coins along said guide channel having a diameter larger than the selected diameter. The separator is adjustable to selected diameters. A control panel is provided to display the coin count and to control coin discharge so as to batch the coins to the packaging element in selected numbers corresponding to standard packaging counts. A totalizer cooperates with the counter to totalize the monetary value of the coins counted by the counter.

8 Claims, 12 Drawing Figures

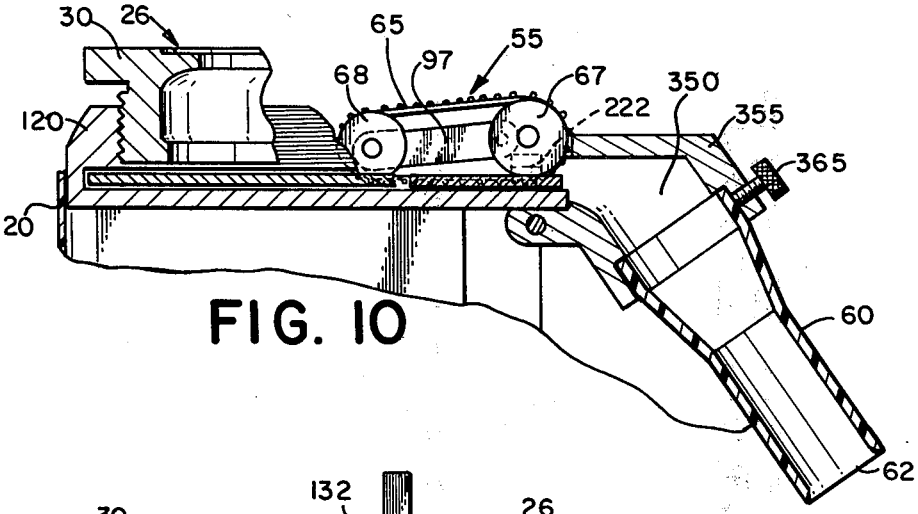
FIG. 10
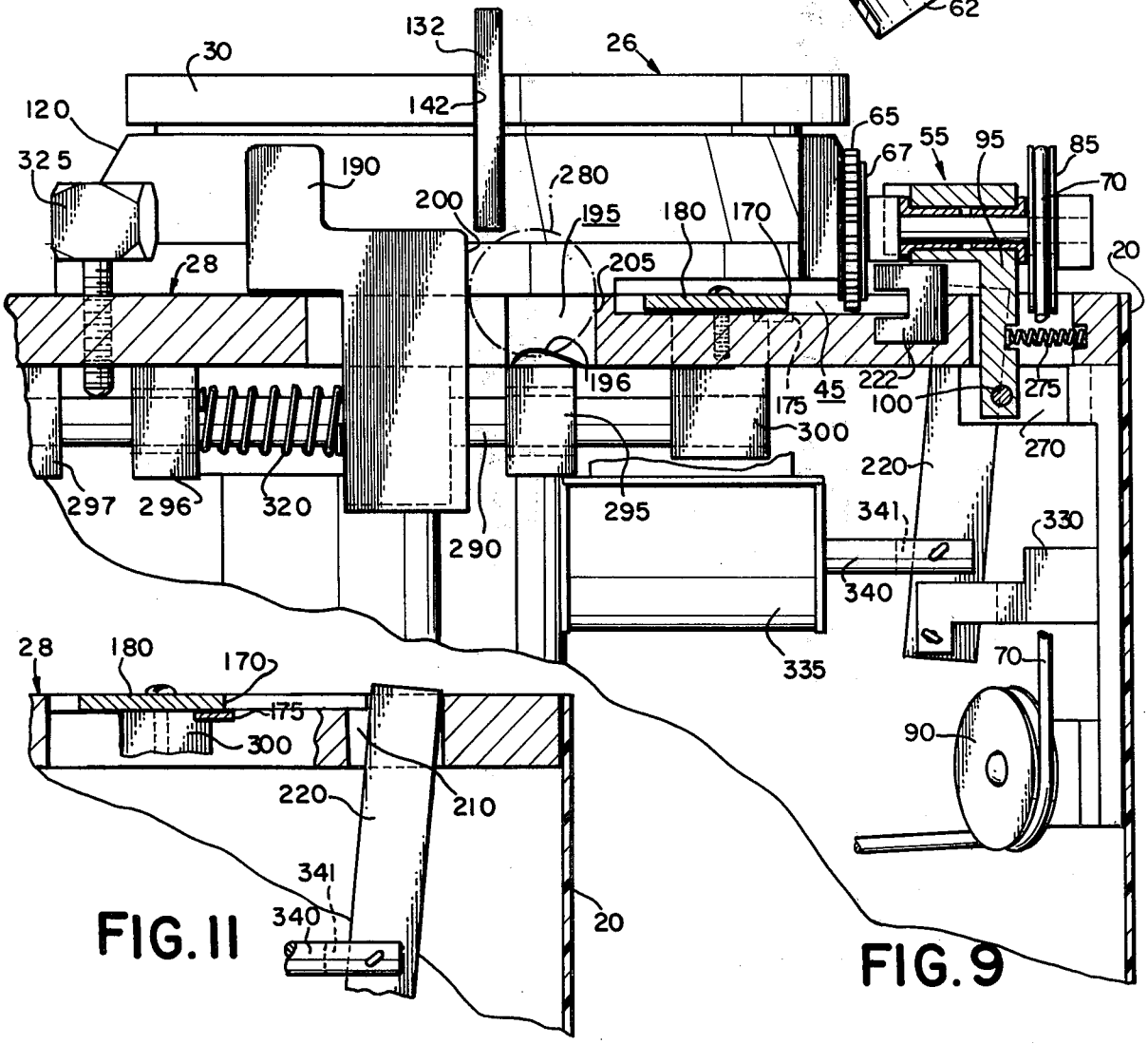
FIG. 11
FIG. 9

COIN COUNTER

FIELD OF THE INVENTION

The present invention generally relates to a coin counter and, more particularly, to a portable apparatus for counting and packaging coins.

BACKGROUND OF THE INVENTION

In various segments of our economy, it is often desirable to have the ability to quickly and accurately count large quantities of coins having various denominations. For example, in the vending industry large quantities of coins having various denominations are often collected at different locations. As a result, it is often desirable to count and totalize the various denominations of coins collected from each vending location as well as retaining a cumulative count and total from selected or all locations.

Since it is burdensome to transport large quantities of coins if they are not properly packaged or wrapped, it is desirable to package each denomination of coin in wrappers or bags while the coins are being counted. To accomplish the packaging of the coins during the counting operation, it is desirable to have the ability to count and package the coins at each location. Although the coins are normally sorted according to their denomination at each location, frequently coins of different denominations or other off-size coins become intermixed with the sorted coins. If the coins are packaged simultaneously during the counting operation, it is necessary to separate intermingled off-size coins before counting and packaging one particular denomination. Since it is desirable to count the coins at each location quickly and accurately, manual sorting out of the off-size coins is inefficient.

SUMMARY OF THE INVENTION

The present invention provides an apparatus for counting and packaging coins which enables an operator to quickly, accurately, and efficiently count and totalize various denominations of coins at different locations while providing capability for cumulative totals. The apparatus also batches the coins in proper quantities for packaging.

Briefly stated, the present invention provides a portable apparatus for counting and packaging coins of various denominations while having the capability to cumulate the total value and number of each denomination of coin counted. The apparatus includes a housing having coin inlet means for receiving coins to be counted and coin outlet means for discharging the counted coins. The apparatus includes means defining a coin passageway through the housing from the coin inlet means to the coin outlet means. Conveyor means is provided for conveying coins of a selected thickness and diameter successively through the coin passageway from the coin inlet means to the coin outlet means. Gate means is provided in the coin passageway for preventing the conveyance of coins having a thickness greater than a selected threshold thickness while enabling the conveyance of coins having a thickness less than the selected threshold thickness. The gate means includes qate-adjustment means for adjusting the selected threshold thickness to different selected amounts. Separator means is provided in the coin passageway for separating coins from the coin passageway having a diameter smaller than the selected threshold diameter while enabling the conveyance of coins through the coin passageway having a diameter at least equal to the selected threshold diameter. The separator means includes separator-adjustment means to enable the adjustment of the selected threshold diameter to different selected diameters. The gate means and separator means insure that only the selected denomination of coin is counted. Counter means is provided in the coin passaqeway beyond the gate means and the separator means for counting coins being conveyed through the coin passageway to the coin outlet means. Batching means is coupled to the counter to group the coins in standard quantities for packaging. Totalizer means are provided for totalizing the monetary value of the coins counted by the counter means. The totalizer means cooperates with the counter means so that whenever the counter means counts a coin of a particular denomination the totalizer means totalizes the monetary value of the coin being counted.

BRIEF DESCRIPTION OF THE DRAWINGS

The foregoing summary as well as the following detailed operation of a preferred embodiment of the invention will be better understood when read in conjunction with the appended drawings in which:

FIG. 9 is a fragmentary sectional view of the apparatus as taken along line 9—9 of FIG. 2;

FIG. 10 is a cross sectional view the apparatus taken along line 10—10 of FIG. 9;

FIG. 11 is a fragmentary sectional view taken on the lines 11—11 of FIG. 6.

DETAILED DESCRIPTION OF THE INVENTION

Figure 1:
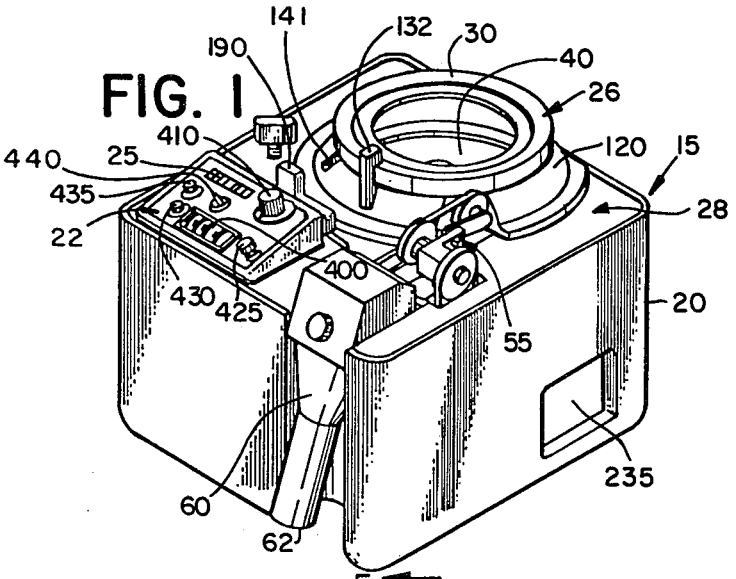
FIG. 1 is a perspective view of the coin counter apparatus in accordance with the preferred embodiment of the present invention.
Figure 2:
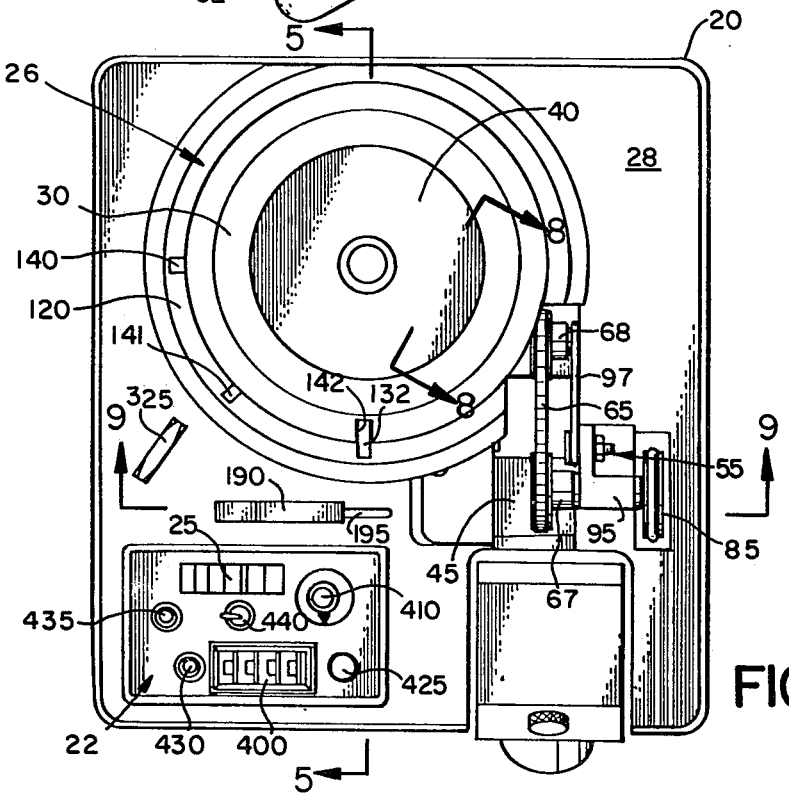
FIG. 2 is a plan view of the apparatus illustrated in FIG. 1.

Referring to the drawings and initially to FIGS. 1 and 2, in accordance with the present invention a portable coin counter 15 for counting and totalizating various denominations of coins includes an outer protective housing 20 and an operator panel 22 with means to select the monetary amount and quantity of each denomination of coin processed by the apparatus. The coin counter is adapted to batch each denomination of coin for packaging as it is processed through the apparatus.

To enable the operator of the apparatus to select and control the various operating functions of the apparatus, the panel board 22 has a plurality of manual switch means readily accessible to the operator. The switch means control the various counting and totalizer function of the apparatus. The panel board also includes display means 25 for displaying the number and value of each denomination of coin processed by the apparatus within an operator-controlled time period.

Figure 5:
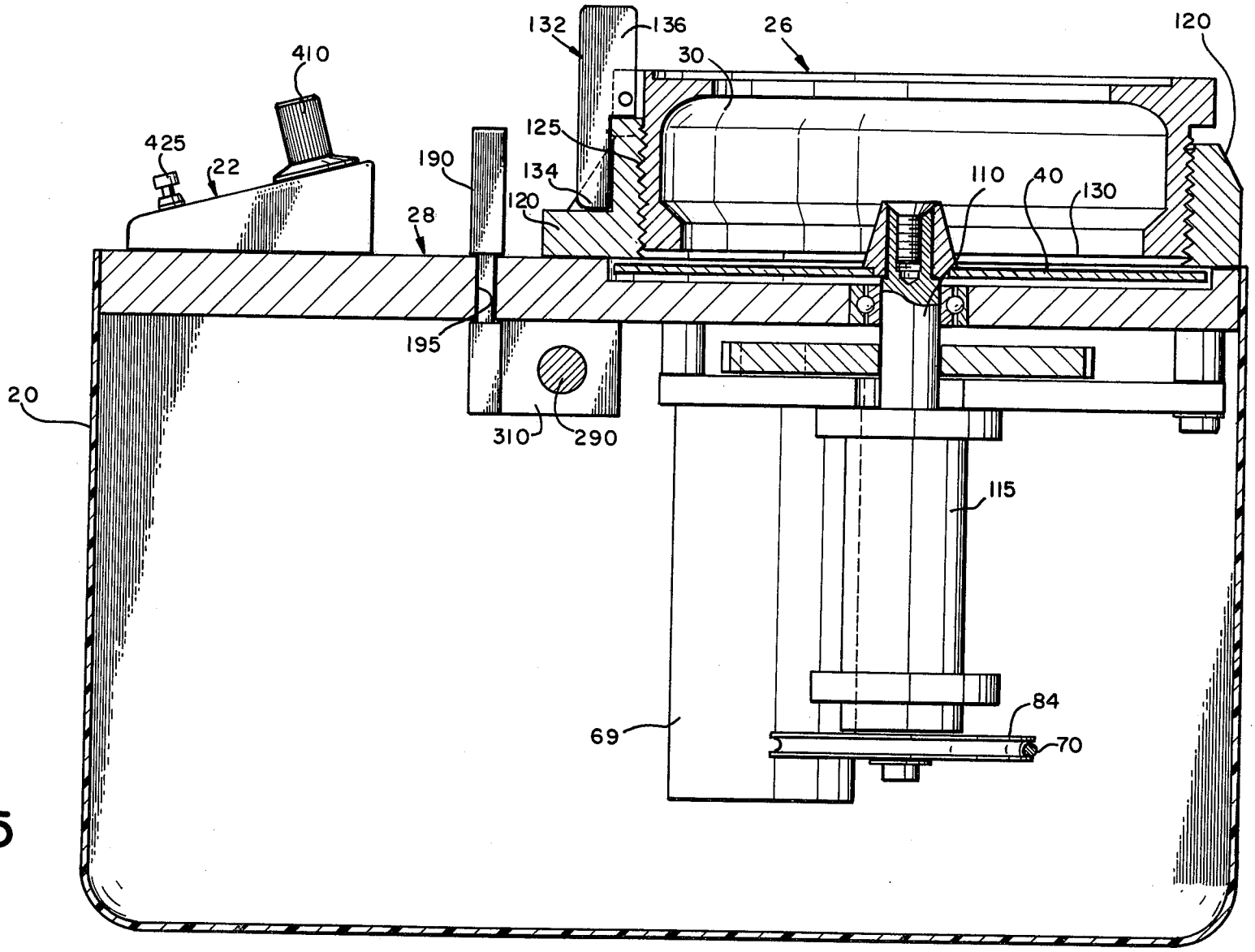
FIG. 5 is a sectional view of the apparatus as taken along line 5—5 of FIG. 2.

Once the control panel is properly adjusted for a selected operating mode, the coins which are to be counted are deposited in the coin counter 15 through switchable coin inlet means. For this purpose, the upper surface 28 of the coin counter includes a coin hopper bin 26 for receiving the coins to be counted. As best shown in FIG. 5, the coin hopper bin includes a ring 30 having generally vertically oriented tubular interior side walls projecting above the upper horizontally disposed surface 28 of the housing 20.

The coins to be counted are introduced into the coin hopper bin and lie flat upon a horizontally-disposed rotatable turntable 40 defining the bottom surface of the coin hopper bin 26. As shown in FIG. 5, the diameter of the turntable is greater than the interior diameter of the ring 30. The turntable is motor driven so that its rotation causes coins in the hopper bin to move toward the outer circumference of the turntable where the coins may pass under the ring 30 and be subsequently and successively discharged from the coin hopper bin through an orifice 250 (see FIG. 8) at the base of the ring 30 along the outer circumference of the turntable 40.

From the orifice 250 of the coin hopper bin, the coins are successively fed into a guide channel 45 within the upper surface 28 of the coin counter. The guide channel includes opposing side walls and a bottom wall for supporting and guiding horizontally-disposed coins as they travel along the guide channel. The coins are conveyed horizontally along the guide channel by a coin drive assembly 55. As the coins are conveyed toward the end of the guide channel 45, counter means are provided to count and accumulate the total number of coins conveyed along the guide channel. Totalizer means are employed in cooperation with the counter means for totalizing the monetary value of the coins counted by the counter means. The results are displayed on the display means 25 of the control panel 22 informing the operator of the number and the monetary total of the selected denominations of coins counted.

Beyond the coin transport channel 45 the coins are fed into the top of a coin discharge tube 60 disposed and supported at the end of the guide channel and are subsequently discharged from a coin outlet 62 at the bottom of the coin discharge tube 60. The coins being discharged from the coin outlet can be packaged in conventional coin wrappers or bags which are positionable in registry with the coin outlet 62 at the bottom of the coin discharge tube 60.

To convey the coins along the guide channel 45, the coin-drive assembly 55 includes a coin transport belt 65 tightly stretched between a belt-driven drive pulley 67 and a cooperating free pulley 68. The pulleys 67 and 68 are oriented and supported at the opposing ends of the guide channel so that the lower run of the coin transport belt extends longitudinally along the guide channel between the drive pulley 67 and the free pulley 68. The coin transport pulley includes an exposed treaded surface, and the drive and free pulleys 67 and 68 are disposed so that the treaded surface of the coin transport belt overlies the guide channel 45 along the entire length thereof, the drive pulley 67 being disposed proximate to the coin discharge tube 60 and the free pulley 68 being disposed proximate to the rotatable turntable 40 of the coin hopper bin 26. As coins are successively fed from the turntable 40 onto the guide channel 45, the coins lie flat so that the treaded surface of the coin transport belt 65 engages the upper surface of each coin and conveys the coin along the coin guide channel 45 from the turntable 40 toward the coin discharge tube 60.

Figure 3:
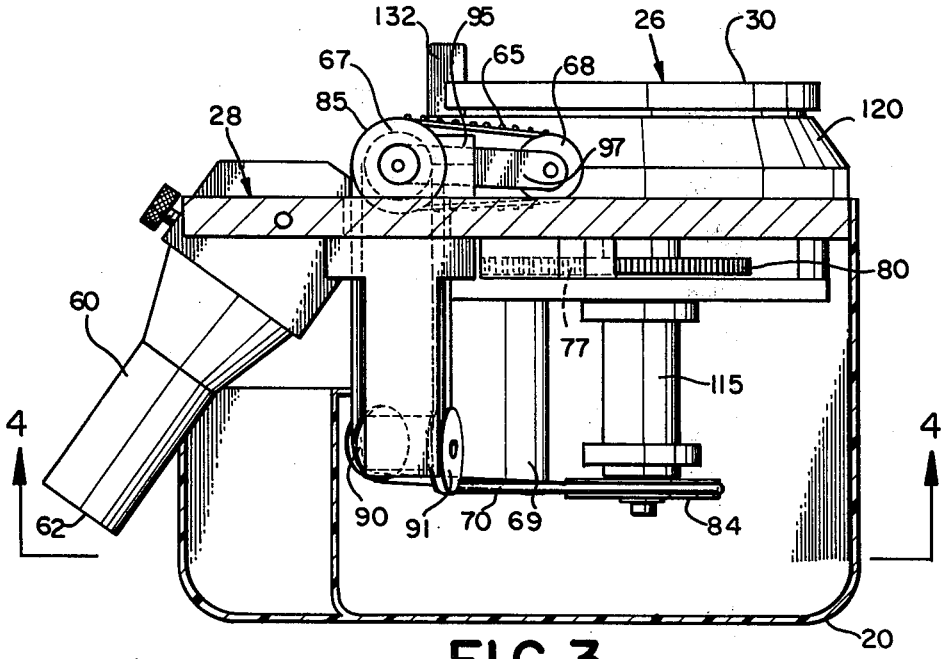
FIG. 3 is a side view of the apparatus illustrated in FIG. 1 with parts cut away.
Figure 4:
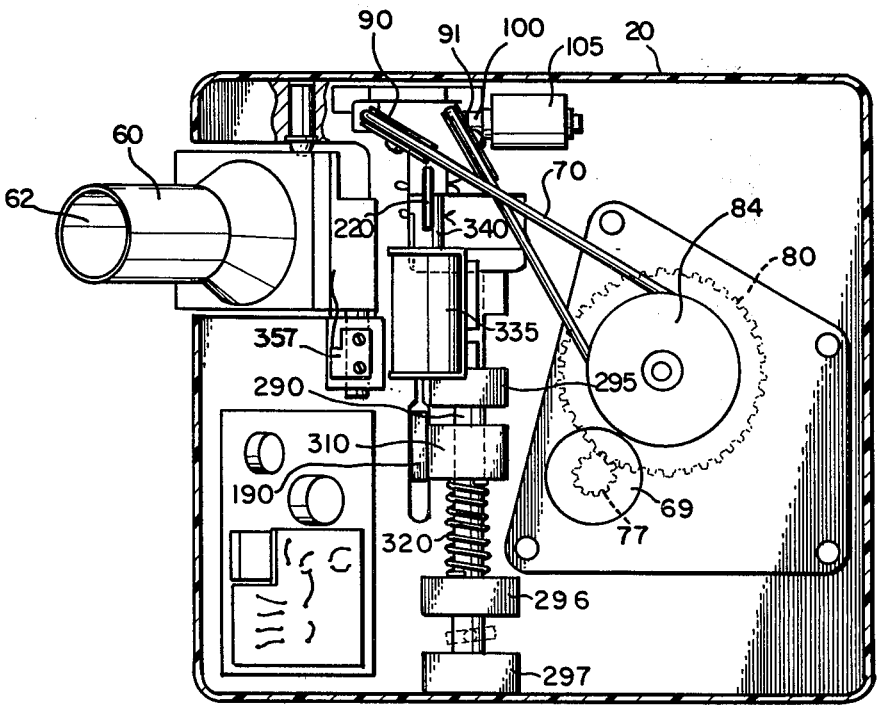
FIG. 4 is an inverted sectional view of the apparatus taken along line 4—4 of FIG. 3.

The coin-drive assembly is driven concurrently with the turntable 40. As illustrated in FIGS. 3 and 4, the turntable 40 is driven by an electric motor 69 which is geared to a spindle 110, as shown at 77 and 80 in FIG. 4. A motor-driven drive pulley 84 which is mounted on the lower end of the turntable spindle 110 and drives the coin-drive assembly 55 through pulleys 90, 91 and 85 and the drive belt 70.

The belt drive for the coin drive assembly enables the assembly to be displaced from the guide channel 45 and to be biased into firm engagement with the coins therein. To this end the assembly is supported by a support element 95 (see FIG. 9) pivotally mounted on the housing 20. The free pulley 68 for the coin transport belt 65 is connected to one end of a pivot arm 97 (FIG. 3), which, in turn, is pivotally connected at its opposing end to the support element 95. The pivot arm is vertically pivotable about the support element 95 to permit the upward and downward movement of free pulley 68 relative to the guide channel 45. When the pivot arm is positioned in its lower generally-horizontal orientation, the coin-drive assembly 55 is ready for operation wherein the coin transport belt 65 will operably engage coins on the guide channel 45 for conveyance along the guide channel 45. The pivot arm may be moved vertically upward into an inoperable position out of engagement with coins in the guide channel 45 to permit access to the guide channel 45 in the event of coin jamming at the entrance thereto. If a coin conveyed from the turntable into the guide channel 45 jams therein, free pulley 68 may be pivoted upward for easy access to and removal of the jammed coin.

The support element 95 is pivotally mounted within the housing to permit movement of the pulley 67 and 68 upwardly from the guide channel 45 and in a direction away from the coin hopper bin 26. As illustrated in FIG. 4, the pivotal mounting includes a shaft 100 journaled in a bearing assembly 105 mounted and supported within the housing. A spring 275 biases the support 95 counterclockwise, as seen in FIG. 9, to urge the bottom treaded surface of the coin transport belt 65 into snug engagement with coins of varying thickness. As coins are fed from the turntable 40 of the coin hopper bin 26 into the guide channel 45, the coin transport belt snugly engages the upper surfaces of the coins and urges them against the bottom wall of the guide channel 45. Thus, the coin transport belt assembly readily accommodates coins having various thickness.

Referring to FIG. 5, the coin hopper bin 26 and the rotatable turntable 40 is illustrated in greater detail. The turntable 40 is fixedly mounted on the upper edge of a vertically disposed rotational turntable spindle 110 journaled within bearing assembly 115 supported within the housing 20. The turntable 40 is supported on the turntable spindle 110 slightly below the base of the side walls of the ring 30 which is adjustably supported by an annular wall support 120. The wall support 120 and the ring 30 are threaded at 125 to permit the ring 30 to be adjusted upward and downward relative to the upper surface of turntable 40. If the side wall 30 is screwed upwardly away from the upper surface of turntable 40 the clearance between the bottom edge 130 of the side wall 30 and the upper surface of the turntable 40 will be increased. Conversely, if the side wall is screwed vertically downward the clearance will decrease.

A stop lever 132 is pivotally mounted on the outer circumference of the ring 30. The lower end 134 of the stop lever 132 can be pivoted either toward or away from the outer circumference of the annular wall support 120 by a handle portion 136 at the upper end of the stop lever 132. As illustrated in FIG. 2, recesses 140, 141, and 142 are provided along the outer circumference of the annular wall support 120. To permit the upward or downward rotation of the side wall 30, the stop lever 132 is pivoted to disengage its lower end 134 from one of the recesses so that the ring can be rotated to a selected orientation where the lower end 134 of the stop lever 132 can be received by one of the recesses 140, 141, and 142. When engaged in one of the recesses, the stop lever 132 is retained in position by its weight to prevent further rotation of the side wall 30. By retaining the ring in a selected position, the clearance between the bottom edge 130 of the ring and the upper surface of the turntable 40 is adjusted to the desired clearance. For example, the recess 140 provides clearance corresponding to the thickness of a dime; the recess 141 provides clearance corresponding to the thickness of a penny and the recess 142 provides clearance corresponding to the thickness of a nickel, quarter, or a dollar coin.

Figure 6:
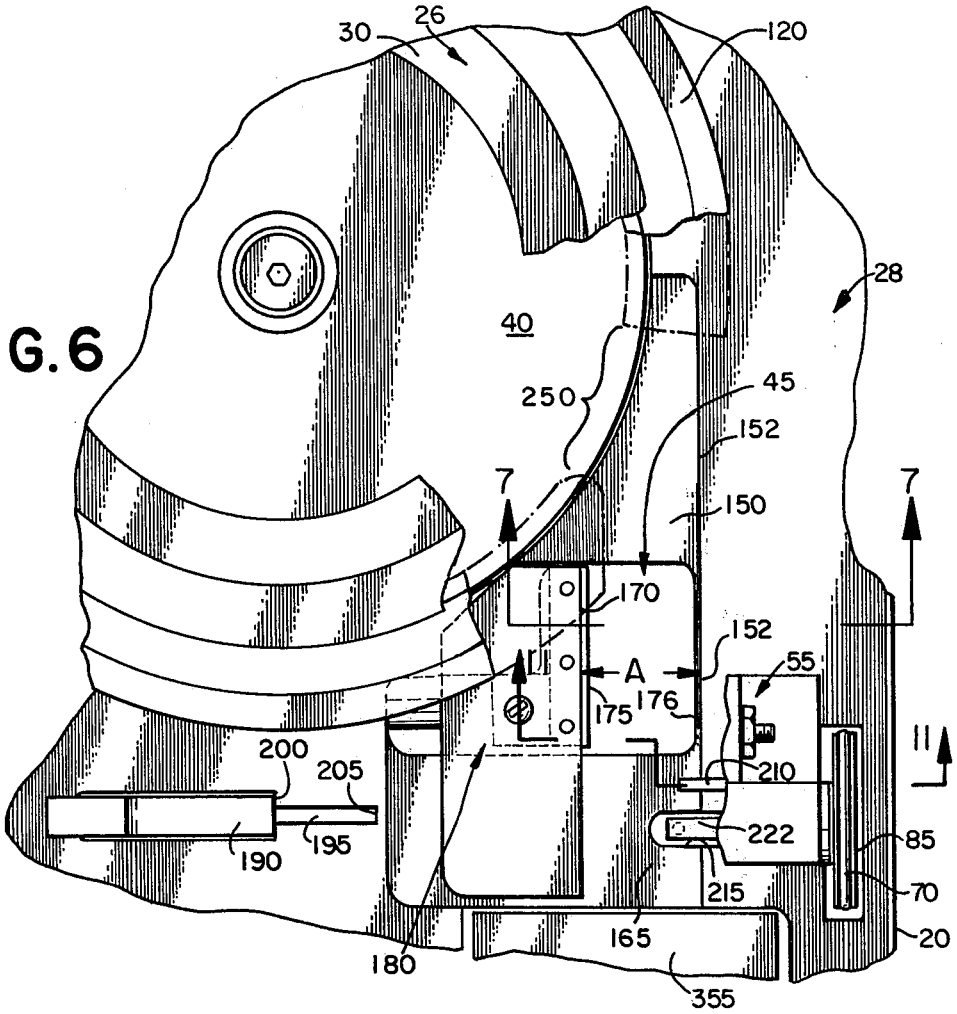
FIG. 6 is a fragmentary plan view of the apparatus illustrated in FIG. 1 having its coin-drive assembly removed for clarity.

In FIG. 6, the ring 30 of the coin hopper bin 26 and the cooperating annular wall support 120 have been partially broken away to more clearly illustrate the cooperation between the turntable 40 and the guide channel 45 as well as the coin conveyance path from the turntable 40 to the front of the guide channel 45. The broken away part of the annular wall 120 has been shown in broken lines to illustrate the orifice 250 leading from the interior of the ring 30 to the guide channel 45. As previously described, the coins fed into the coin hopper bin 26 of the apparatus are fed into the guide channel 45 by the rotation of the turntable 40. Coins are initially fed onto a generally horizontally disposed feed platform 150 for the guide channel 45. The feed platform 150 is lower than the upper surface 28 of the housing such that a vertical side wall 152 is defined opposite the turntable 40 and functions to guide the coins being fed over the feed platform 150 from the rotating turntable 40 into the channel 45.

Means is provided to reject or discharge offsize coins under a preselected diameter and to block offsize coins of greater diameter from passing into the feed channel 45. To this end, the guide channel 45 includes a coin discharge opening 155 in the bottom wall of the guide channel 45 intermediate the feed platform 150 for the guide channel 45 and an output platform 165 disposed at the opposite end of the guide channel 45. The output platform 165 of the guide channel 45 is provided at the same level as the feed platform 150 so that coins successively passing over the coin discharge opening 155 are conveyed from the feed platform 150 to the output platform 165 through the guide channel 45 without impedence. The coin discharge opening 155 is intermediate the rear edge of the feed platform 150 and the leading edge of the output platform 165, so that the opening 155 functions to separate undersized coins from the guide channel 45. The transverse width of the guide channel is determined by the distance between the vertical side wall 152 and a transversely displaceable retaining wall 170 on the opposite side of the channel 45. Horizontally disposed support rails 175 and 176 are respectively provided longitudinally along the base of the retaining wall 170 and the base of side wall 152 along the entire length of the coin discharge opening 155. The support rails 175 and 176 are extremely narrow and project only slightly under the guide channel 45 to define therebetween the discharge opening 155. The support rails 175 and 176 extend in the same horizontal plane as the feed platform 150 and the output platform 165 to define the bottom wall of the guide channel 45 so that coins of the desired diameter are conveyed from the feed platform onto the output platform 165 with the support rails 175 and 176 supporting the opposite edges of the coin as it passes over the coin discharge opening 155.

The vertical retaining wall 170 and the support rail 175 disposed at its base are part of a transversely-displaceable slide member 180. As described hereinafter, the slide member 180 is mounted for adjustment in the transverse direction relative to the guide channel 45 such that the width of the channel 45 can be adjusted.

Since coins being conveyed over the coin discharge opening 155 are supported at their opposite edges by the narrow support rails 175 and 176, coins having a diameter smaller than the distance of separation between the opposing edges of the support rails 175 and 176 will fall through the coin discharge opening and will not be conveyed by the coin drive assembly onto the output platform. However, coins having the proper diameter to fit within the channel 45 between the vertical retaining wall 170 and its opposing vertical side wall 152 will be conveyed from the feed platform 150 to the output platform 165 over the coin discharge opening 155. The transverse width of the coin discharge opening 155 is illustrated in FIG. 6 as distance A, and defines the minimum threshold diameter at which coins will successfully pass over the coin discharge opening. Undersized coins, i.e. coins having a diameter smaller than the threshold diameter, will fall through the coin discharge opening 155 and are separated from the guide channel 45, whereas coins having the desired diameter are conveyed over the coin discharge opening 155 to the output platform 165. Oversize coins, i.e. coins, having a diameter larger than the desired diameter are prevented from passing into the diameter since the coin cannot pass between the opposing vertical side and retaining walls 152 and 170. Such oversize coins may be removed manually from the feed platform 150. It should be noted that vending locations, and in particular vending machines, rarely permit oversize coins to fall in with coins of a desired denomination.

The transverse width of the channel 45 can be properly adjusted to the desired width by means of an adjustment element handle 190 cooperating with a coin gaging slot 195 in the upper surface 28 of the housing (see FIGS. 2, 6 and 9). For example when handling a given denomination of coin, such coin is positioned within the coin gaging slot 195 as shown at 280 in FIG. 9. The adjustment handle 190 has an abutment edge 200 defining one edge of the coin gaging slot 195. An abutment wall 205 defines the opposing edge of the slot. The adjustment element 195 and the slide member 180 are interconnected so that movement of the adjustment element 195 is translated into corresponding movement of the slide member 180 in a direction transverse to the guide channel 45. To effect the adjustment, the slide member 180 and the adjustment element 195 are mounted on a slide rod 290 which is supported by slide supports 295, 296 and 297 in the housing 20. The slide supports permit transverse movement of the slide member 180 which is mounted at one end of the slide rod 290 by a mounting bracket 300. The adjustment element 195 is fixedly connected with the slide rod 290 by mounting element 310. To ensure that the abutment edge 200 of the adjustment element 190 is brought into snug engagement with the coin placed within the coin gaging slot 195, spring means 320 is mounted along the slide rod 290 intermediate the slide support 296 and the mounting element 310 of adjustment element 190 to urge the adjustment element 190 toward the abutment wall 205 within the coin gaging slot 195. To ensure that the slide shaft does not inadvertently move during a coin counting operation a set screw 325 is engageable with the slide shaft to retain it in fixed position. The set screw 325 is disposed intermediate the slide supports 296 and 297.

To adjust the width of the channel 45 to a desired denomination of coin the set screw 325 is loosened to permit the longitudinal movement of the slide rod 290 and to permit transverse adjustment of the slide member 180 against the urging of the spring means 320 to receive the selected denomination of coin as indicated in broken lines in FIG. 9 at 280. The coin gaging slot 195 is disposed along the upper surface 28 of the apparatus and is adapted to receive the selected coin in a generally vertical orientation. The bottom of the slot 195 has a leaf spring 196 to resiliently support the coin. The depth of the slot 195 is dimensioned so that even a relatively small coin will protrude vertically upward above the surface 28 of the housing to permit the operator to easily insert and remove coins from the coin gaging slot. The leaf spring 196 assists in the removal of the coin when the handle 190 is moved back. The operator may easily grasp the exposed portion of the coin protruding above the upper surface 28.

Once the coin is disposed within the coin gaging slot 195, the operator may release the adjustment element 190 to enable the spring means 320 to snugly dispose the coin within the coin gaging slot 195 intermediate the abutment edge 200 and the opposing slot defining abutment wall 205. The set screw 325 can then retain it in position. With the slide rod retained in position, the slide member 180 is in proper adjustment so that the guide channel 45 permits the conveyance of the particular denomination of coin disposed within the coin gaging slot 195 over the coin discharge opening.

Coins passing over the coin discharge opening 155 are subsequently discharged onto the output platform 165 of the guide channel 45. The output platform is defined between the vertical side wall 152 and the slide member 180. Two small slots 210 and 215 are provided along the bottom wall of the output platform 165. The first slot 210 receives an upstanding coin-stopping element 220 displaceable in the slot 210 to block the advance of coins along the output platform 165. During normal operation, the coin stopping element 220 is retracted from its receiving slot 210 so that coins can pass along the output platform 165 of the guide channel 45 without interference. Conversely, when the coin stopping element 220 is advanced into its receiving slot 210 within the guide channel 45, the stopping element 220 blocks the guide channel 45 and prevents further advance of coins along the guide channel 45. The second slot 215 is disposed at a position beyond the first slot 210 to receive an electric eye 222 such that coins successively passing along the output platform of the guide channel 45 trigger a coin count in a computer controlled memory of the coin counter upon detection by the electric eye 222. At the rear end of the output platform 165 beyond the electric eye the coins are successively fed into the coin discharge tube 60 where the coins are subsequently discharged for packaging.

Figure 7:
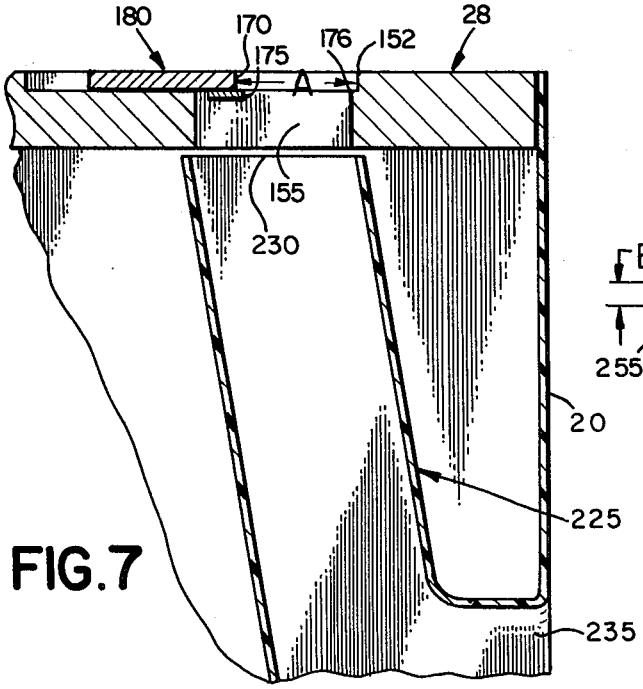
FIG. 7 is a fragmentary sectional view of the apparatus taken along line 7—7 of FIG. 6.

As specifically illustrated in FIG. 7, the coins separated or off-sorted from the guide channel 45 via the coin discharge opening 155 fall into a coin discharge chute 225 directly under the coin discharge opening 155. In the present instance, the coin discharge chute 225 is formed integral with the housing and includes a receiving inlet disposed directly under the coin discharge opening 155 and a small collection bin at the bottom for receiving the off-sorted coins. An access opening 235, as illustrated in FIG. 1, is provided along the side wall of the housing so that the off-sorted coins can be removed from the collection bin.

Figure 8:
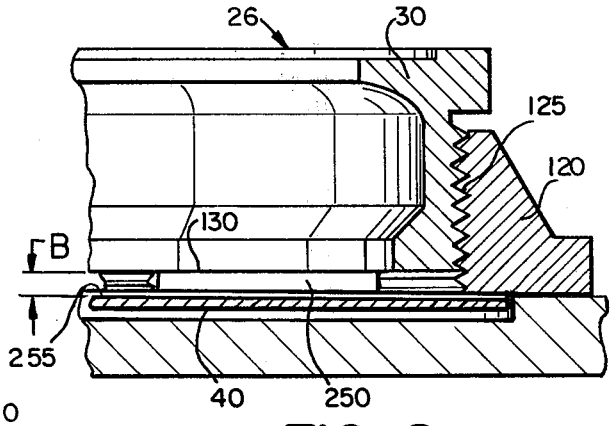
FIG. 8 is a fragmentary sectional view of the apparatus taken along line 8—8 of FIG. 2.

Referring to FIGS. 6 and 8, the coins which are fed from the turntable 40 of the coin hopper bin 26 onto the feed platform 150 must pass through a coin discharge orifice 250 disposed along the outer circumference of the turntable 40. The coin discharge orifice 250 extends through the annular wall 120 along a small arc of the circumference. The horizontal dimensions of the coin discharge orifice 250 are determined by the size of the opening in the annular support wall 120. The coin discharge orifice 250 extends vertically between the upper surface of the platform 150 and the lower edge 130 of the ring 30, but the coin must pass through the clearance between the turntable 40 and the bottom edge 130 of the ring 30. The clearance between the lower edge 130 of the ring 30 and the upper surface 255 of the rotatable turntable 40 can be increased or decreased by the adjustment of the side wall 30 relative to the support wall 120, as illustrated in FIG. 8 at B.

Since coins are discharged from the turntable 40 flat onto the platform 150, the coins of the desired thickness pass from the coin hopper bin 26 onto the guide channel without interference, and coins having a thickness greater than the selected threshold thickness will be retained in the bin 26. Thus, the coin discharge orifice 250 serves as gate means for preventing the passage of selected coins while enabling the passage of other coins depending upon the relative thickness of each coin.

In FIGS. 9 and 11, the operating mechanism for the coin stopping element 220 is illustrated in greater detail. The coin stopping element has its lower end pivotally mounted on a lever support element 330 disposed and supported within the housing 20.

A solenoid 335 is provided to advance and retract the stopping element 220. The solenoid 335 includes an actuator arm 340 pivotally mounting the coin stopping element 220 intermediate its upper and lower ends. The action of the actuator arm 340 of the solenoid 335 causes the coin stopping element 220 to pivot about its support element 330 so that the top portion of the coin stopping element is displaced in and out of the guide channel 45 where it will function to impede the passage of coins or permit the passage of coins along the guide channel 45.

Referring to FIG. 10, the coin drive assembly 55 functions to convey coins along the guide channel and through the electric eye 222 for discharge from the guide channel into a discharge tube support housing 355 pivotally mounted with respect to the apparatus. The discharge tube housing 355 is adapted to receive a coin discharge tube 360, so that tube 360 can be removably inserted and locked by set screw 365. The coin discharge tube 60 receives the coins from the output platform 165, through channel 350 in the support housing 355 and the coins are subsequently discharged from the discharge tube 60 through a coin outlet 62 provided at the base of the coin discharge tube 60. The coin discharge tube 60 includes a funnel-type upper portion which merges into a cylindrical section dimensioned for a particular denomination of coin such that a coin wrapper (not illustrated) can be registered with the coin discharge tube 60 to receive coins from the coin outlet 62. By providing a coin wrapper, the operator can wrap the coins discharged from the coin outlet 62. A different coin discharge tube 60 can be employed for each denomination of coin so that each denomination of coin counted can be simultaneously wrapped when such coins are discharged from the apparatus through the coin outlet 62 of the coin discharge tube 60. As described below, the coin counter actuates the stop lever when the proper number of coins are discharged, so that a standard coin package is automatically achieved.

The discharge tube housing 355 is pivoted so that the discharge tube can be pivoted outwardly for operation and inwardly towards the apparatus for storage. The discharge tube housing 355 preferably communicates with an ON-OFF switch at 357 in FIG. 4 so that whenever the discharge tube housing 355 and its coin discharge tube 60 are pivoted outwardly from the apparatus the ON-OFF switch 357 is activated and the electronics of the apparatus are powered.

Figure 12:
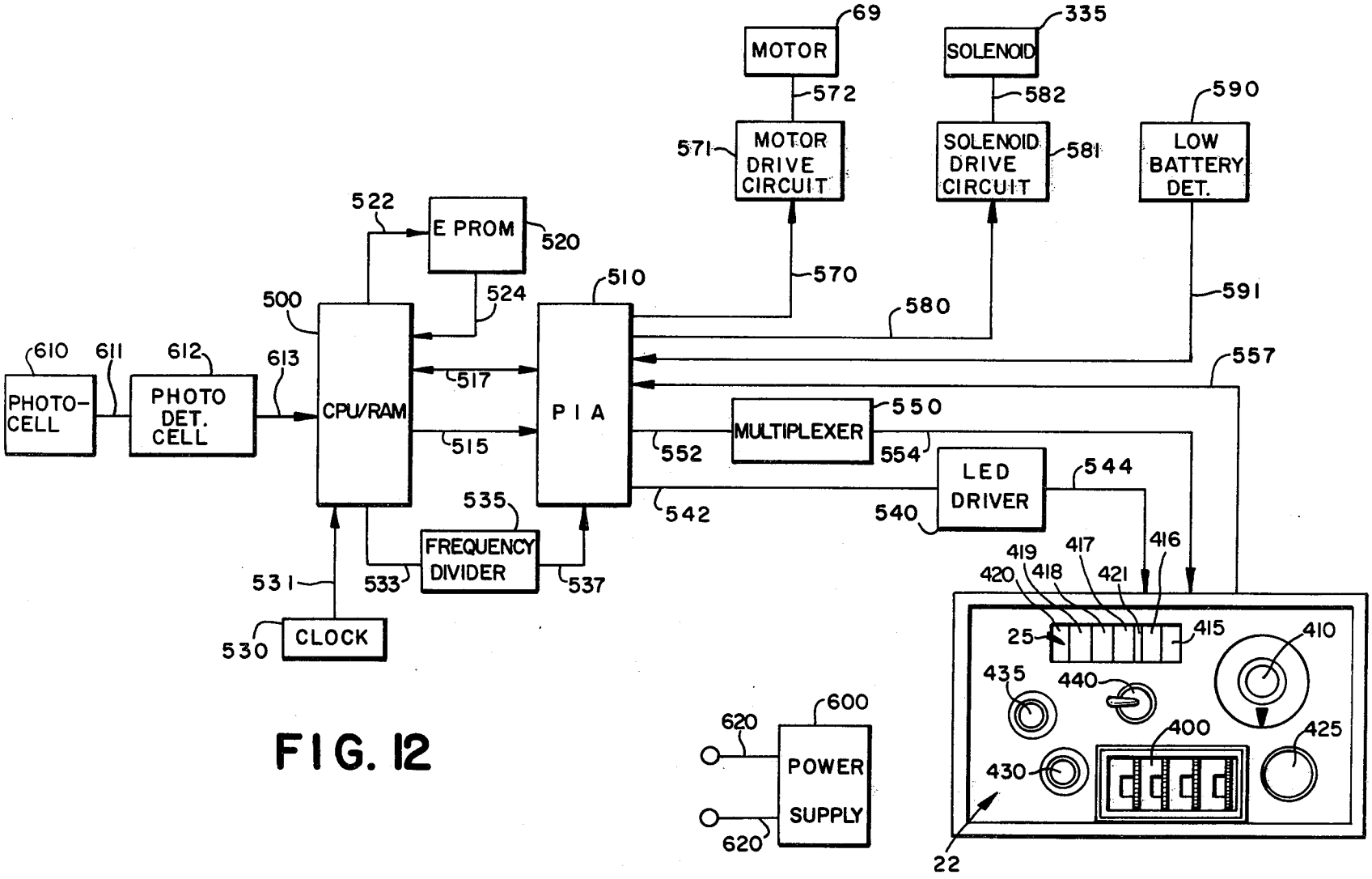
FIG. 12 is a general schematic diagram of the electrical circuitry of the apparatus.

Referring to FIG. 12, the electronic circuitry employed for controlling the various functions of the apparatus is illustrated in block diagram. As previously described, the apparatus includes an operator control panel 22 readily accessible to the operator for the selection of various operating modes performed by the apparatus. The control panel 22 includes a plurality of switches for the selection of particular operating functions.

More specifically, a four-digit thumb wheel switch 400 is provided on the control panel and it functions to control the number of coins to be counted by the apparatus. After the selected thumb wheel count is achieved by coins passing along the electric eye, the stop lever is advanced to arrest the advance of coins into the discharge tube. The operator can adjust thumb wheel switch for a coin count of up to 9,999. For example, if the thumb wheel switch 400 is adjusted for 50 coins, the apparatus will count up to 50 coins and then stop the advance of coins. In the present instance, the settings from 0 to 4 are used for special programs of counting and stopping, and the remaining settings correspond to a unit count in the range of 5 to 9,999, whereby the coin counter will count up to the number displayed by the thumb wheel switch in such range. If the thumb wheel switch is set to 0 the coin counter will continuously count the coins fed into the coin hopper bin without stopping unless a 15 second delay between the passage of successive coins is encountered. If the thumb wheel switch 400 is adjusted so that 1 is displayed, the coin counter will count a full roll of coins for the particular denomination of coin being counted. If the thumb wheel switch 400 is adjusted so that 2 is displayed the coin counter will count a half-roll of the particular denomination of coin selected. If the thumb wheel switch is adjusted to 3 the coin counter will count a full bag of coins and if 4 is selected the coin counter will count a half-bag of coins. Therefore, the operator can adjust the thumb wheel switch to a selected number depending upon the number of coins that the operator wishes to count. If additional programmed counts are needed, the lower end of the unit count range may be increased to accommodate the additional programmed counts since low numbers are seldom utilized for unit counts.

The control panel 22 also includes a rotary money selection switch 410 which enables the operator to select the particular denomination of coin which the operator desires to count. In the present case, the money selection switch can be adjusted to count pennies, nickels, dimes, quarters, or dollars. By adjusting the money selection switch to the particular denomination of coin to be counted, the coin counter through its microprocessor controlled memory can not only provide the operator with a unit count for all coins counted but can also provide the operator with a unit count for each particular denomination of coin counted as well as the total monetary value of the coins counted. Therefore, if the four-digit thumb wheel switch 400 is set at 50 and the money selection switch is set for dimes, once 50 dimes are counted from the coins placed into the apparatus through the coin hopper bin the display means 25 provided on the control panel 22 can alternatively display the total number of coins counted, i.e., 50, or the monetary value of the total number of coins counted, i.e., $5.00.

To display the results, the display means comprises a six-digit LED (light emitting diode) display with an optional decimal point display for use in displaying monetary totals rather than unit counts. As shown in FIG. 12, with the six-digit LED display 25, the coin counter can display a unit count up to 999,999 and a monetary value of up to $9,999.00. The display means 25 includes a separate LED display module 415, 416, 417, 418, 419 and 420 for each digit displayed as well as a decimal display 421.

The control panel 22 also includes a start/stop switch 425 for activating the electric motor and initiating and stopping the counting operation. Once the coin discharge tube is displaced outwardly from the apparatus to activate the ON-OFF switch in communication therewith, the start/stop switch 425 must be depressed to enable the turntable and the coin drive assembly to operate so that coins in the coin hopper bin can be conveyed through the apparatus. Initially depressing the start/stop switch 425 initiates the counting operation. Depressing the start/stop switch again will cause the turntable and the drive assembly to stop operation and will cause an interruption of the counting operation. However the interruption of the mechanical operation of the coin counter will not interrupt the unit count of all the coins counted, the unit count for each denomination of coin counted or the monetary value of all coins counted which are stored within the microprocessor controlled memory. Only the physical conveyance of coins through the apparatus will cease due to the stopping of the electric motor. For example, if the thumb wheel switch is set at 50 and only 25 coins have been counted when the start/stop switch is depressed to stop the motor, the coin counting operation will be temporarily interrupted since coins cannot be conveyed through the apparatus. However, the number of coins counted and stored in memory will remain at 25. Therefore, if the start/stop switch is once again depressed to commence the counting operation, the apparatus will count the remaining 25 coins at which point the count condition of 50 set by the thumb wheel switch will be satisfied and the motor will cease operation to prevent further conveyance of coins through the guide channel. The stopping element will also be displaced into the guide channel to prevent the passage of another coin due to inertia. As a result, the start/stop switch will temporarily interrupt the mechanical counting of the coins but will not interrupt the coin count stored in the micro-processor controlled memory.

To reset the coin count stored in the micro-processor controlled memory, the panel board includes a depressible reset switch 430. By depressing the reset switch 430, the operator can reset the coin count stored in the memory to 0. In the previous example, the thumb wheel switch was set for a coin count of 50 and only 25 coins were counted when the operation of the coin counter was interrupted by the depression of the start/stop switch. The coin counter then commenced operation, upon depression of the start/stop switch, at the unit count of 25. However, if the operator desires the coin counter to commence its counting operation at 0 even though the thumb wheel selection requirement of 50 has not yet been satisfied, the operator can depress the reset switch 430 which will reset the coin count stored in the micro-processor controlled memory from 25 back to 0. As a result of the reset, the coin count stored in memory must be incremented 50 times before the thumb wheel selection requirement of 50 is met. Accordingly, the reset switch 430 on the control panel 22 is utilized to reset the coin count stored in the micro-processor controlled memory back to 0.

The control panel 22 also includes a depressible display or count reset switch 435 which functions merely to reset the LED display back to 0. The display reset switch 435 does not control the number of coins to be counted nor the number of coins stored in memory but only controls the display of the output. With reference to the previous example in which the thumb wheel switch is set at 50 and the apparatus operation is interrupted at a count of 25, display means will display the count of 25. Depressing the display reset 435 switch will cause the LED display to be reset at 0. However, the 25 unit count will still be retained in the micro-processor controlled memory so that when the counting operation is once again commenced the coin counter will only count 25 additional coins to satisfy the thumb wheel requirement of 50. However, since the display means was reset to 0 at the 25 count, the display means will only display the count of the additional 25 coins when the thumb wheel requirement of 50 is met. Accordingly, the display reset switch 435 merely controls the display of the output and does not control the count stored in the micro-processor controlled memory.

The control panel 22 also includes a three position toggle switch 440 for the selection of various operating modes. The mode switch 440 can be adjusted by the operator to its first position to display the number of units counted by the apparatus. The mode switch can be adjusted by the operator into its second position to display the monetary value of the coins counted. The mode switch can also be adjusted by the operator into a third position. By then adjusting the money selection switch to the desired denomination of coin, the number of coins counted for the particular denomination selected on the money selection switch will be displayed. In the third position the mode switch functions with the money selection switch to permit the display the number of units counted for each denomination of coin.

To effect operation the apparatus includes a central processing unit for controlling the operation of the apparatus and memory means for the storage of desired input and output information. More specifically, the apparatus includes a micro-processor 500 having integral CPU (central processing unit) and integral RAM (random access memory). Micro-processors having an integral CPU and RAM are well known to those skilled in the art and may be purchased commercially as packaged integrated circuitry, for example, Motorola Part No. 6802.

To interface the CPU/RAM 500 with the various input and output circuitry of the apparatus, interfacing means is provided. For this purpose, the apparatus includes a programmable PIA (peripheral interface adapter) 510 for interfacing various input and output siqnals to and from the CPU/RAM 500. The programmable PIA is well known to those skilled in the art and may be purchased commercially as packaged integrated circuitry, for example, Motorola Part No. 6821. The PIA is interconnected with the CPU/RAM via a plurality of address lines shown collectively as 515 and a plurality of bidirectional data lines shown collectively as 517.

To store the operational program for the apparatus, memory means for program storage is provided. For this purpose, the apparatus includes an EPROM (programmable read only memory) 520 which is reprogrammable through the use of ultra-violet light and which is of a type well known in the art. The EPROM may be purchased commercially as packaged integrated circuitry, for example, Intel Semiconductor Part No. 2716. Although an EPROM is specifically utilized, it is possible to utilize other memory means for the storage of the operational program. However, it is desirable to utilize a chip such as the EPROM to retain the operational program so that in the event of power interruption to the apparatus the operational program will not be lost. Suffice it to say, however, that the EPROM stores the operating program for the apparatus and is interconnected with the CPU/RAM 500 via a plurality of address lines collectively illustrated as 522 and via a plurality of data lines collectively illustrated as 524.

Clock means 530 is provided to ensure proper timing of the various signals throughout the circuitry. The clock means 530 includes a 4 MHz oscillator connected to the CPU/RAM 500 via line 531. Clock signals are provided to the PIA 510 from the CPU/RAM 500 through line 533 through a frequency divider 535 and subsequently through line 537 so that a 1 KHz signal is supplied to the PIA 510. The frequency divider comprises a pair of BCD (binary coded decimal) counters which are interconnected to function as a frequency divider. The BCD counters are of the type well known in the art and may be purchased commercially as packaged integrated circuits, for example, Fairchild Part Nos. 74LS160 and 4518. Suffice it to say that the BCD counters are interconnected to function as a frequency divider so that a 1 KHz timing signal is supplied to the PIA 510.

The PIA 510 includes a plurality of ports which are initialized under program control as input ports or output ports when the apparatus is initially energized. Designated programmed output ports of the PIA 510 are connected to an LED driver 540 via a plurality of lines collectively illustrated as 542. The LED driver 540 is of the type well known in the art and may be purchased commercially as packaged integrated circuitry, for example, Fairchild Part No. 9368. The LED driver 540 is connected to the six seven-segment light emitting diode (LED) display modules 415, 416, 417, 418, 419, and 420 via a plurality of lines collectively illustrated as 544. The LED display modules are of the type well known by those skilled in the art and may be purchased commercially as packaged units. The LED driver 540 supplies driving signals to the LED display modules via line 544 to provide an output display to the operator.

Digital switch means are provided to interconnect the various inputs and outputs of the display panel with the PIA 510. For this purpose, a digital multiplexer 550 is provided. The digital multiplexer 550 is of the type well known in the art and may be purchased commercially as packaged integrated circuitry, for example, Fairchild Part No. 4028. Designated programmed output ports of the PIA 510 are connected to the digital multiplexer 550 via a plurality of lines collectively illustrated as 552. The digital multiplexer 550 is, in turn, connected to the control panel 25 via a plurality of lines collectively illustrated as 554. The digital multiplexer 550 functions to switch and distribute the input signals from its input lines 552 to its various output lines collectively illustrated as 554. The output lines 554 from the digital multiplexer 550 are connected to the LED display modules 415, 416, 417, 418, 419, and 420 and provide enabling signals to permit operation of the LED display modules when output signals are received from LED driver 540. The output lines 554 of the digital multiplexer 550 are simultaneously connected to the money selection switch 410, to the display or count reset switch 435 and to each of the digits of the four digit thumb wheel switch 400. The digital multiplexer 550 provides enabling signals to each of the above-specified switches to enable the three switches to provide input information to programmed input ports of the PIA 510 via a plurality of input lines collectively illustrated as 557.

The mode toggle switch 440, the start/stop switch, and the reset switch 430 of the control panel are also connected to the PIA via output lines 557 such that input information from the switches can be provided to designated programmed input ports of the PIA 500. However, these three switches are not connected to the digital multiplane and as a result do not receive enabling signals from the digital multiplexer 550. Therefore, the coin selection switch, the thumb wheel switch, and the display or count reset switch only provide signals to the PIA 510 via output lines 557 when such switches are provided with enabling signals from the digital multiplexer 550. However, the mode toggle switch, the start/stop switch, and the count reset switch need not receive enabling signals to provide input signals to the PIA 510 via lines 557 from the control panel.

A designated programmed output port of the PIA 510 is connected to the motor 69 via output line 570 and motor drive interfacing circuitry 571. The motor drive interfacing circuitry 571 conditions the signal received from the PIA via line 570 to provide a conditioned drive signal to the motor 69 via line 572. The motor drive interfacing circuitry 571 is conventional circuitry known to those skilled in the art and a detailed description thereof is not believed to be necessary for a complete understanding of the present invention.

A designated programmed output port of the PIA 510 is also connected with the solenoid 335 via line 580 and solenoid drive interfacing circuitry 581. The solenoid drive interfacing circuitry 581 functions to condition the signal received from the PIA 510 via line 580 to provide an operating signal to the solenoid 335 via line 582. The solenoid drive interfacing circuitry 581 is conventional and is well known to those skilled in the art so that a more detailed description of the sollenoid drive interfacing circuitry 581 is not believed to be necessary for a complete understanding of the present invention.

A designated programmed input port of the PIA 510 is connected with a low battery detection circuit 590 via input line 591 so that whenever the internally portable 12-volt battery of the apparatus is utilized as a power supply 600 the low battery detection circuit 590 will function to detect a reduction in output power from the battery so that a weak battery signal can be displayed to the operator. The low battery detection circuitry is conventional and well known to the those skilled in the art so that a more detailed description of the circuitry and operation is not believed to be necessary for a complete understanding of the present invention. Suffice it to say that the low battery detection circuit 590 is provided to detect a decrease in output from the internal 12-volt battery utilized as the power supply 600 and provides a conditioned warning signal to the PIA 510 via input line 591.

To count coins passing along the guide channel, the electric eye 222 of the apparatus comprises a photocell 610 disposed along the coin guide channel 45 such that coins passing along the guide channel 45 at the position of the photocell 610 successively break a beam of light enabling detection by the photocell 610. The photocell 610 detects the interruption of the beam of light and generates a detection signal to the CPU/RAM 500. The detection signal is provided to the CPU/RAM 500 through an input line 611, through photodetection interfacing circuitry 612 and into the CPU/RAM 500 via line 613. The photodetection interfacing circuitry 612 conditions the detection signal received from the photocell 610 and provides a conditioned signal to the CPU/RAM 500 via line 613. The photodetection interfacing circuitry 612 is conventional and well known to those skilled in the art so that a more detailed description of the circuitry and operation is not believed to be necessary for a complete understanding of the present invention. Suffice it to say that the photodetection interfacing circuitry 612 provides signal conditioning so that a conditioned input signal is provided to the CPU/RAM via input line 613.

A power supply 600 is provided to power the above described components and circuitry. For purposes of clarity, in the figure, the power supply 600 is not shown as being directly connected to the various components it being understood that the output lines 620 from the power supply 600 are in actuality operably connected to the various components and circuitry, as required. The power supply 600 includes an internal 12-volt supply battery to facilitate the portability of the apparatus. The apparatus is also adapted to receive power from a 12-volt car battery. The internal 12-volt battery provides power to the above described components and circuitry through a conventional 5-volt D.C. regulator and smoothing capacitor.

To operate the apparatus, the coin discharge chute is displaced outwardly from the apparatus to activate the ON-OFF switch in communication therewith. The CPU/RAM 500 then runs through a short program loop fixed internally by the CPU to reset its internal registers and to initialize the CPU from the power down condition. After the CPU is initialized it addresses the EPROM 520 through address lines 522 to obtain its program instructions from the operating program stored in the EPROM. The EPROM 520 provides program instruction signals to the CPU/RAM 500 via data line 524. The CPU/RAM 500 is interconnected with the PIA 510 and addresses the PIA 510 over address lines collectively illustrated as 515. Data signals are transmitted back and forth between the CPU/RAM 500 and the PIA 510 over bi-directional data lines collectively illustrated as 517. Initial program instructions from the EPROM 510, program the PIA 510 to initialize its various ports as either input ports or output ports.

After the CPU/RAM 500 and the PIA 510 are initialized, the CPU awaits the reception of an input signal via the start/stop switch 425 on the control panel 22. The input signal from the start/stop switch goes from the control panel 22 to the PIA 510 via input line 557 where the information is transferred to the CPU/RAM 500 via data line 517.

Before depressing the start/stop switch 425 on the control panel to initiate operation of the machine, the operator must first adjust the money selection switch to the desired denomination of coin being counted and also adjust the four-digit thumb wheel switch to the appropriate number of coins to be counted. After selecting the desired coin count on the four-digit thumb wheel and adjusting the money selection switch to the proper denomination of coin, the operator pushes the start/stop switch. Upon programmed instructions from the EPROM 520, the CPU scans the money selection switch via input signals to the CPU from the money selection switch. The signals are inputted to the CPU through line 557, through the PIA 510 and through data line 517. The CPU scans the money selection switch to ascertain the denomination of coin being counted. The CPU under program control then scans the four-digit thumb wheel switch via input signals from the thumb wheel switch to ascertain the number of coins which are to be counted. The CPU under program control then sends out a motor control signal via the PIA 510 through output line 570 to activate the motor and to commence mechanical operation of the coin counter. The CPU under program control then awaits to receive input signals from the photocell 610 through the input line 613.

As each coin is detected by the photocell 610 the CPU increments the monetary value of the coin as determined by the money selection switch and stores the incremented monetary value of the coins in the RAM memory. The CPU under program control then increments the unit count by 1 and stores the incremented with count in the RAM. The CPU under program instructions from the EPROM then compares the new unit count to the input from the thumb wheel which is also stored in the RAM to determine if the thumb wheel input is equal to the unit count. If the amounts are not equal the coin counter continues to count. However, if the new unit count equals the input from the thumb wheel, the CPU under program control signals for the motor to stop. The CPU also signals for the activation of the solenoid 335 for a third of a second to cause the displacement of the coin stopping element into the guide channel to prevent the passage of the next coin through the guide channel 45 due to inertia whenever the operation of the motor is ceased. The CPU under program control then enables the unit count, the monetary total or the unitary count of a particular denomination of coin to be displayed depending upon the position of the mode switch 440.

A Zener diode is included with the power supply 600 so that 5 volts DC is supplied to portions of the RAM when the apparatus is shut off. By supplying 5 volts to the RAM through the Zener diode the upper most 35 bytes of the RAM are energized so that the computer will retain the unit count, the monetary total, and the unitary count for each denomination of coin in the RAM even when the apparatus is shut off.

Therefore, when the apparatus is initially energized the upper 35 bytes of the RAM are not reset. The RAM stores a selected number from the EPROM in the upper most 35 bytes of the RAM so that when the CPU and EPROM are first initialized the CPU under program control compares the selected number from the EPROM with the number stored in the RAM. If these numbers match the memory is valid and retained. If the numbers do not match the memory is then reset. The number stored in the RAM and the number obtained from the EPROM will not match if the battery has gone dead or if the safety fuse provided in the circuitry has been removed. Otherwise, the top 35 bytes of the RAM which store the coin count, the monetary value of the coins counted, and the total number of units of each denomination of coin counted can only be reset by depressing both reset switches 430 and 435 for an interval of at least 3 seconds. Depressing both reset switches for the 3 second interval will cause the CPU under program control to reset the top 35 bytes of the RAM memory to 0. However, if the RAM memory is kept active, the apparatus can provide the operator with the total number of units counted, the total dollar value of all of the units counted, and the number of units of each denomination of coin counted even after the apparatus is turned off. This enables a continuous memory, for example, when the apparatus must be utilized at several vending locations and is turned off in the interim.

Since the CPU receives its program instructions from the EPROM 520, it will be obvious to one skilled in the art that the EPROM can be programmed to provide a counting operation for various denominations of coins including foreign currency and that various other changes could be made to alter the programmed steps or the memory capability. Furthermore, a detailed explanation of the biasing, circuitry and operation of each of the above-described components was not provided since it is not believed to be necessary for a complete understanding of the present invention, such explanations being readily available from the respective manufacturers of the components. Furthermore, while certain preferred embodiments of the present invention have been illustrated and described, the present invention is not limited thereto but may be variously embodied by one skilled in the art within the scope of the following claims.

What is claimed is:

1. A coin counter comprising:

a housing;

coin inlet means for receiving coins to be counted;

coin outlet means for discharging counted coins;

means defining a coin passageway through said housing from said coin inlet means to said coin outlet means;

conveyor means for advancing coins successively through said coin passageway from said coin inlet means to said coin outlet means;

gate means and separator means disposed in said coin passageway enabling the conveyance of coins of a selected thickness and diameter through said coin passageway, said gate means and separator means having adjustment means for adjusting said selected thickness and diameter for a selected coin denomination;

counter means disposed in said coin passageway beyond said gate means and separator means for counting coins conveyed through said coin passageway to said coin outlet means and for storing the count; and totalizer means cooperating with said counter means having input means for registering the monetary value of the selected denomination of coin and means for computing and storing the monetary value of the coins counted by said counter means.

2. A coin counter in accordance with claim 1 wherein said counter means comprises:

coin detecting means disposed in said coin passageway for detecting each coin conveyed along said coin passageway at the position of said coin detecting means; and means responsive to the coin detecting means for successively incrementing and storing the coin count; and said totalizer means comprises means responsive to the coin detecting means for successively incrementing and storing the monetary value by the value of the denomination of coin registered by the input means.

3. A coin counter in accordance with claim 1 including display means and selector means coupled with said display means for selectively displaying the coin count and the monetary value of the coins counted on said display means.

4. A coin counter in accordance with claim 1 wherein said input means includes means to change the monetary value registered upon adjustment of said gate means and separator means.

5. A coin counter according to claim 3 wherein said display means and selector means is operable to separately display the count and value of each coin denomination.

6. A coin counter comprising:

a housing;

coin inlet means having a coin hopper bin with a bottom and side wall for receiving coins to be counted;

coin outlet means for discharging counted coins;

means defining a coin passageway through said housing from said coin inlet means to said coin outlet means;

conveyor means for advancing coins successively through said coin passageway from said coin inlet means to said coin outlet means;

gate means including a coin discharge orifice defined by clearance space between the bottom and side wall of said coin hopper bin to permit the passage of coins therethrough having a thickness less than the selected clearance and to impede the passage of coins therethrough having a thickness greater than said selected clearance, said side wall of said coin hopper bin being selectively adjustable with respect to the bottom wall to alter the clearance of said coin discharge orifice; and counter means disposed in said coin passageway beyond said gate means for counting coins conveyed through said coin passageway to said coin outlet means.

7. A coin counter in accordance with claim 6 wherein said side wall of the coin hopper bin includes:

an annular support wall surrounding the bottom of the bin, said annular support wall defining the horizontal extent of said coin discharge orifice; and an adjustable screw ring movably threaded and engaged with the annular support wall for determining the vertical extent of said coin discharge orifice to selected degrees.

8. A coin counter comprising:

a housing;

coin inlet means for receiving coins to be counted;

coin outlet means for discharging counted coins;

means defining a coin passageway through said housing from said coin inlet means to said coin outlet means;

conveyor means for advancing coins successively through said coin passageway from said coin inlet means to said coin outlet means;

separator means disposed in said coin passageway having means defining a coin discharge opening along a bottom of said coin passageway, coin support means in the bottom of said passageway on opposite sides of said opening for supporting and enabling the advance over the coin discharge opening of coins having a selected diameter greater than the width of the opening, while causing coins having a diameter smaller than the selected diameter to fall through said coin discharge opening and out of said coin passageway, and adjustment means having a coin gaging slot for gaging said selected diameter for a selected denomination of coin, said gaging slot having means for receiving a coin of any selected denomination and means for equalizing the selected diameter of said coin passageway at said coin discharge opening to the diameter of said coin to enable conveyance of the same denomination of coin over said coin discharge opening on said support means; and counter means disposed in said coin passageway beyond said separator means for counting coins being conveyed through said coin passageway to said coin outlet means.

* * * * *